US005928046A

United States Patent [19]

Constan-Tatos

[11] Patent Number: 5,928,046

[45] Date of Patent: Jul. 27, 1999

[54] FLOTATION AID

[75] Inventor: Jeanette Sheelagh Constan-Tatos, Meyerton, South Africa

[73] Assignee: Cadelec CC, Meyerton, South Africa

[21] Appl. No.: 09/029,367

[22] PCT Filed: Jul. 4, 1997

[86] PCT No.: PCT/IE97/00047

§ 371 Date: May 7, 1998

§ 102(e) Date: May 7, 1998

[87] PCT Pub. No.: WO98/01336

PCT Pub. Date: Jan. 15, 1998

[30] Foreign Application Priority Data

Jul. 4, 1996 [ZA] South Africa ..... 96/5674

[51] Int. Cl.[6] ..... B63C 9/08

[52] U.S. Cl. ..... 441/118; 441/88

[58] Field of Search ..... 441/111–118, 80, 441/88, 123

[56] References Cited

U.S. PATENT DOCUMENTS

| | | | |
|---|---|---|---|
| 3,193,856 | 7/1965 | Coolidge | 441/123 |
| 3,366,984 | 2/1968 | Le Blanc, Jr. | 441/118 |
| 4,654,016 | 3/1987 | Pendleton . | |

FOREIGN PATENT DOCUMENTS

| | | |
|---|---|---|
| 201112 | 7/1923 | United Kingdom . |
| 1110402 | 4/1968 | United Kingdom . |
| 9000333 | 10/1991 | United Kingdom . |
| 2 245 227 | 1/1992 | United Kingdom . |

*Primary Examiner*—Ed L. Swinehart

*Attorney, Agent, or Firm*—Clifford W. Browning; Woodard, Emhardt, Naughton Moriarty & McNett

[57] ABSTRACT

A flotation or buoyancy aid comprises an elongate substantially straight flexible strip of closed cell foam material (12) bent into a U-configuration so as to define a pair of arm portions (12A, 12B) extending from a bight portion (34). The bight portion (34) is arranged to rest behind the neck of the user and the arm portions (12A, 12B) are arranged to extend downwardly over the shoulders and chest of the user. A pair of securing straps (16, 24) are passed through reinforced apertures (18, 20, 26, 28) in the arm portions (12A, 12B) so as to hold the arm portions in position against the chest of the user. The invention extends to a method of manufacturing a flotation aid, which includes, inter alia, the steps of cutting the strip from a block of foam material and spraying a conformal coating on the strip so as to form an integral skin.

16 Claims, 3 Drawing Sheets

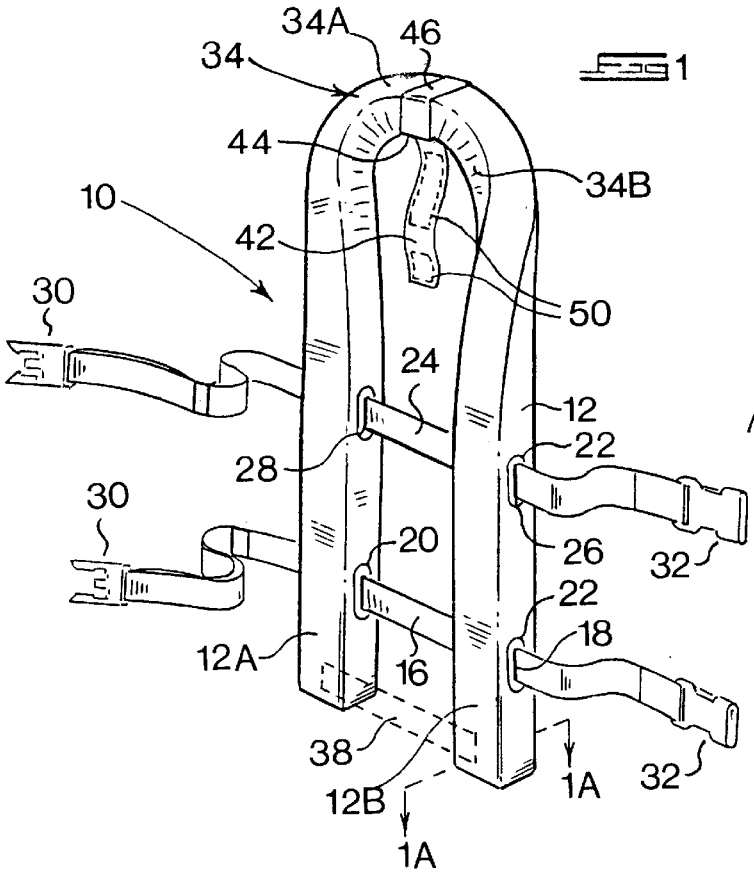
Fig 1
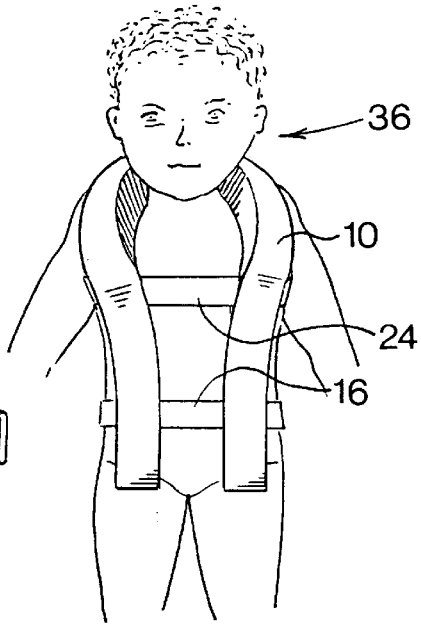
Fig 2
Fig 1A
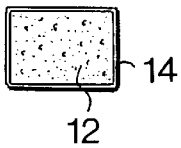
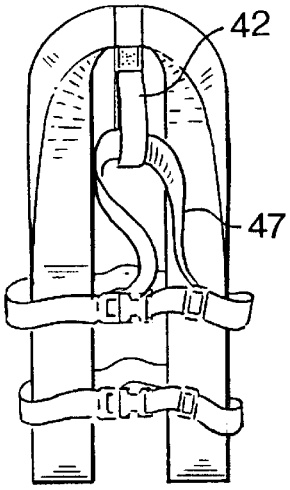
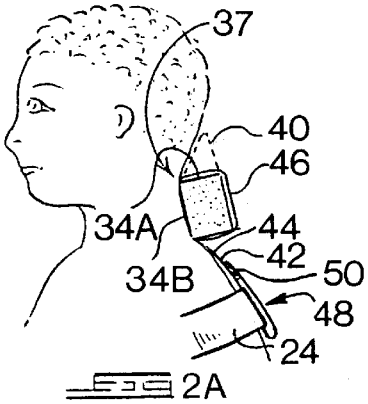
Fig 2A
Fig 2B

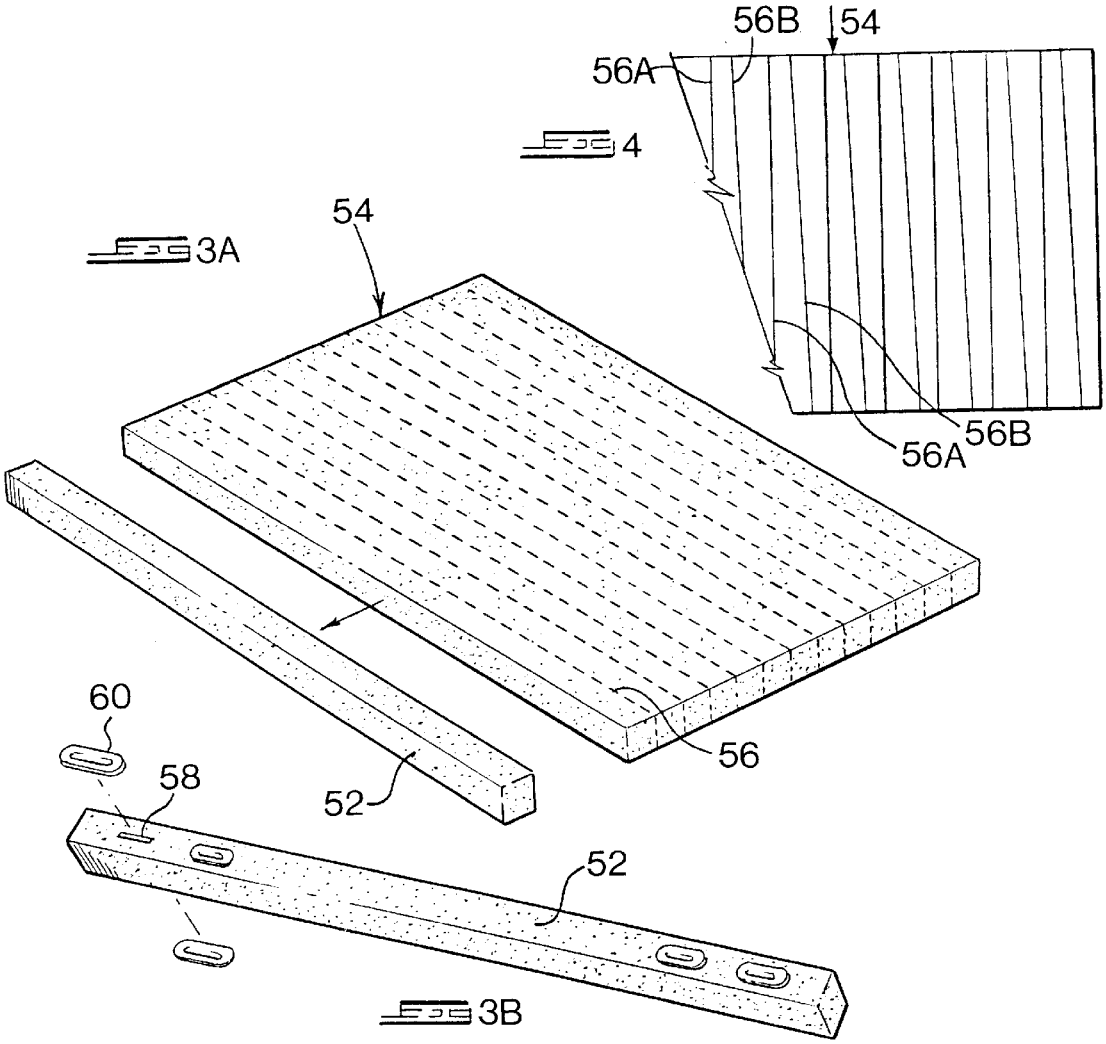
56B
54
56A
4
54
3A
56A
56B
56
60
58
52
52
3B
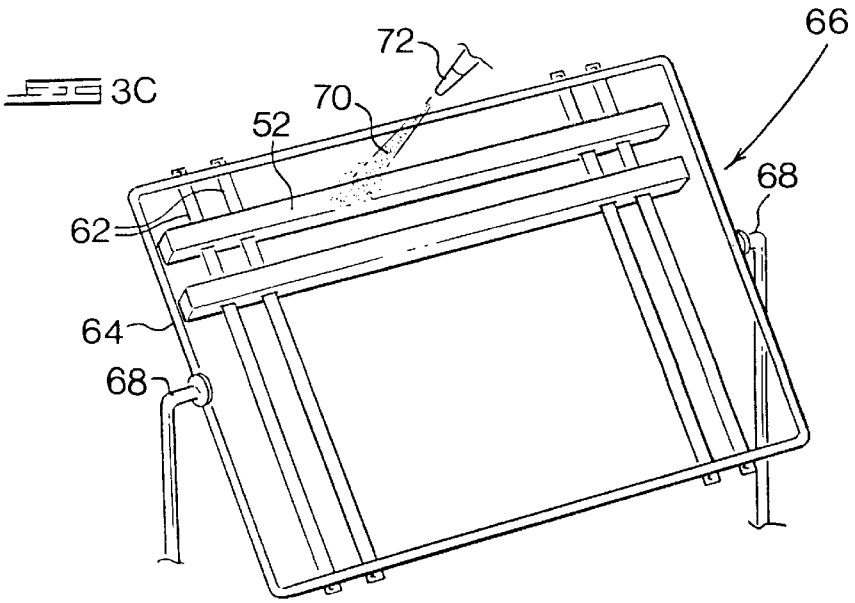
66
72
3C
70
52
68
62
64
68

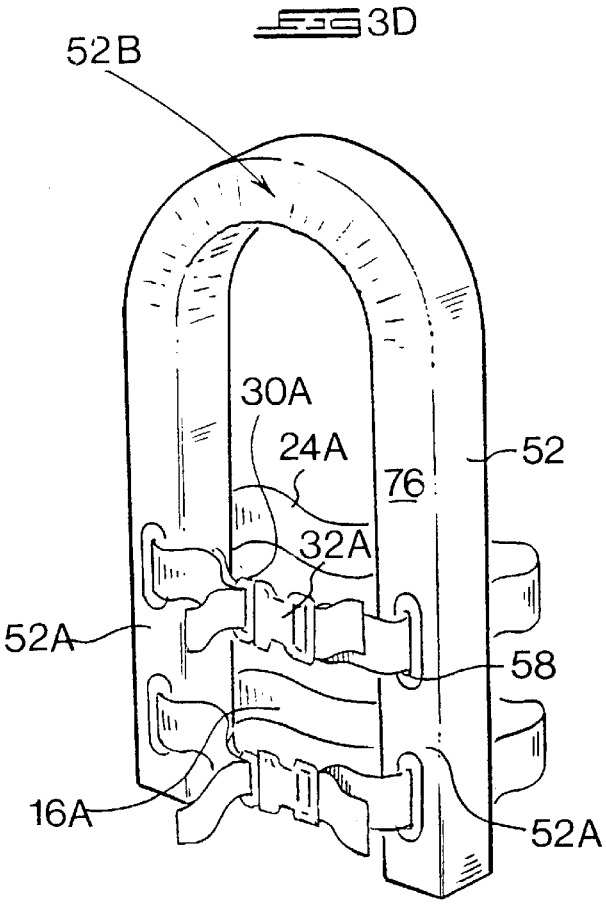
3D
52B
30A
24A
76
52
32A
52A
58
16A
52A
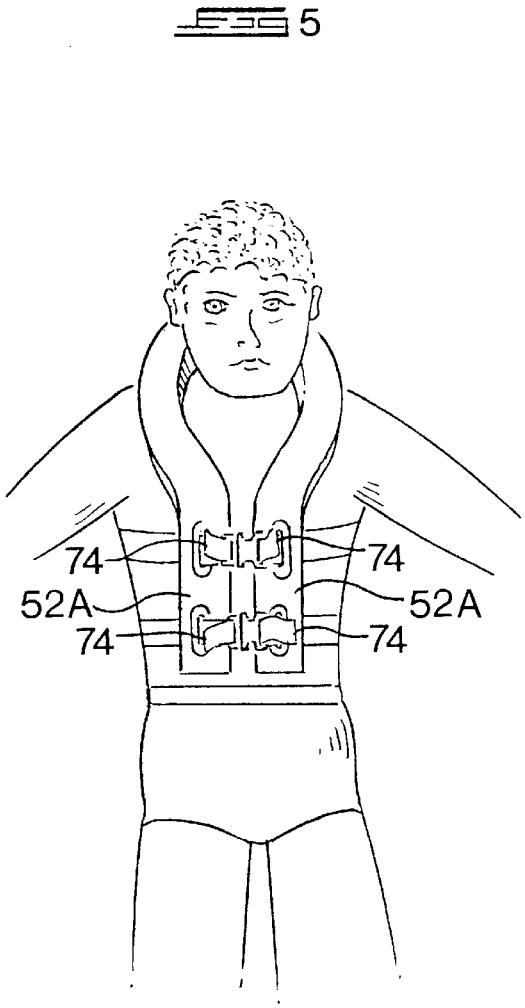
5
74
74
52A
52A
74
74
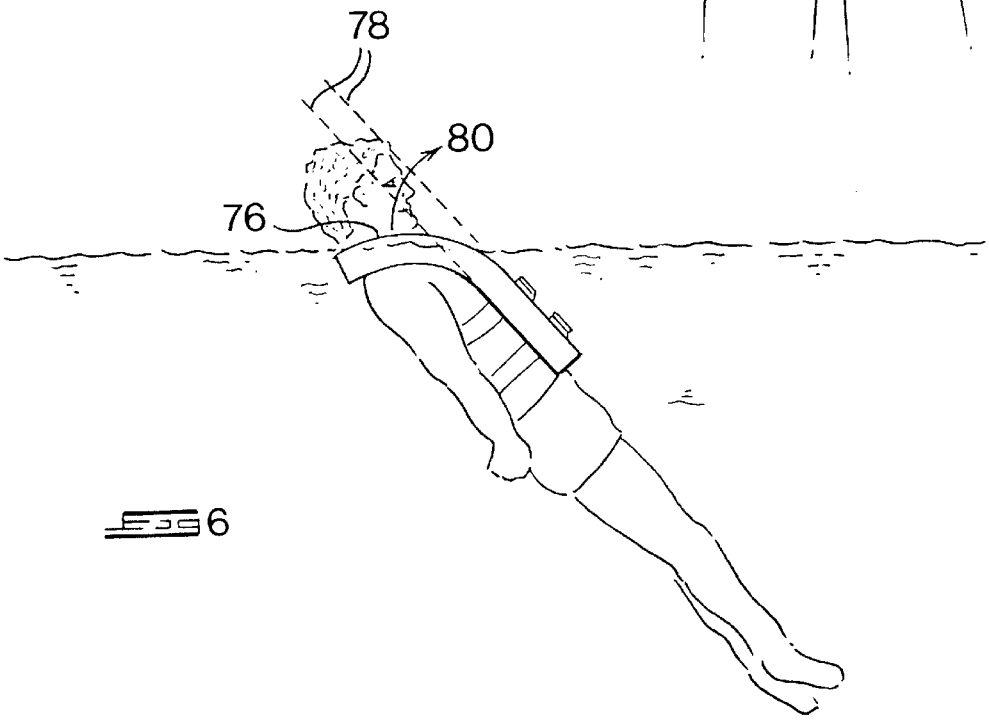
78
80
76
6

FLOTATION AID

BACKGROUND TO THE INVENTION

This invention relates to a flotation or buoyancy aid.

Traditional life jackets or life preservers are often stowed away and not worn due to the fact that they are often resrictive and uncomfortable, especially in warmer climates. Life jackets may also tend to interfere with normal swimming or paddling motions, making them unsuitable for use by canoeists, life savers and the like.

Life jackets are also generally only available in a limited range of sizes, which do not extend down to infants up to 2 years, for which, to the best knowledge of the applicant no effective buoyancy aids currently exist.

It is an object of the invention to provide a primary or supplemental buoyancy aid which, whilst not necessarily conforming with minimal life jacket or life preserver buoyancy specifications, can be worn by a wide age and ability range of persons involved in water-related activities where life jackets are usually not worn due to the fact that they are not compulsory.

It is also an object of the invention to provide a buoyancy aid which is hard-wearing and which is relatively simple and economical to manufacture.

SUMMARY OF THE INVENTION

According to a first aspect of the invention there is provided a flotation aid comprising an elongate substantially straight strip of a flexible closed cell foam material bent into a U-configuration so as to define a pair of arm portions extending from a bight portion and securing means connected to the arm portions, whereby the bight portion is arranged to rest behind the neck of a user and the arm portions are arranged to extend downwardly over the shoulders and chest of the user, the securing means being arranged to extend around the torso of the user for holding the arm portions in position against the chest of the user.

In a preferred form of the invention, the elongate strip of foam material has a substantially constant cross-sectional area along its length.

In an alternative form of the invention, the strip of foam material has a gradually increasing cross-sectional area along its length.

Conveniently, the strip of foam material is rectangular in cross-section.

Advantageously, the securing means comprises at least one strap connected to the arm portions by passing through a corresponding strap-receiving aperture extending through each arm portion, whereby the spacing between the arm portions can be adjusted with each aperture preferably being provided with at least one reinforcing grommet.

More advantageously, each of the arm portions is formed with at least a pair of strap-receiving apertures for receiving an upper chest strap and a lower waist strap.

Preferably, the strip of foam material is provided with a covering, which more preferably comprises an integral skin.

In one form of the invention, the flotation device may include a retaining strap anchored at a fixed end to the bight portion and including fastening means at a free end thereof for fastening it detachably to an intermediate rear portion of the chest strap.

The strip of foam material is preferably pre-cut from a block of foam.

The foam material is typically a PVC foam material and the integral skin is a conformal spray-coated PVC skin.

The invention extends to a method of manufacturing a flotation aid comprising the steps of:

a) providing a plurality of substantially straight flexible elongate strips formed from closed cell foam material;

b) bending each strip into a U-configuration so as to define a pair of arm portions extending from a bight portion; and c) anchoring a securing strap to the arm portions, whereby the bight portion is arranged to rest behind the neck of a user and the arm portions are arranged to extend downwardly over the shoulders and chest of the user, with the securing strap being arranged to extend around the torso of the user for holding the arm portions in position against the chest of the user.

Preferably, the method includes the steps of forming at least two strap receiving apertures in each strip, and slidably anchoring the securing strap by passing it through the apertures.

Conveniently, the method includes the initial step of cutting a plurality of substantially straight elongate strips from a block of foam material.

Advantageously, the method includes the step of applying a covering by spraying a coating on each strip, the coating comprising a solution which conforms with the foam material so as to form an integral skin therewith.

The method may include the farther step of applying at least one reinforcing grommet around at least one opening of each sap-receiving aperture Conveniently, the block of foam is prismatic in form, and parallel rectilinear cuts are made in the block of foam so as to define rectangular cylindrical strips of foam having a substantially constant cross-sectional area along their length.

In an alternative form of the invention, rectilinear cuts are made in the foam with adjacent cuts being non-parallel and alternate cuts being parallel so as to define trapezoidal strips of foam having a gradually increasing area along their length.

BRIEF DESCRIPTION OF THE DRAWINGS

FIG. 1 shows a perspective view of a first embodiment of a flotation aid of the invention;

FIG. 1A shows a cross-section on the line 1A—1A of FIG. 1;

FIG. 2 shows a front view of the flotation aid of FIG. 1 being worn by a swimmer;

FIG. 2A shows a partly cross-sectional side view of the flotation aid in position on the swimmer;

FIG. 2B shows a rear view of the flotation aid;

FIGS. 3A to 3D show various steps in the manufacture of a second embodiment of a flotation aid of the of the invention;

FIG. 4 shows a schematic plan view of an alternative first step in the manufacture of a third embodiment of a flotation aid of the invention;

FIG. 5 shows a front view of the second embodiment of a flotation aid of the invention being worn by a swimmer; and FIG. 6 shows a side view of the flotation aid of FIG. 5 illustrating the manner in which the swimmer is kept buoyant.

MODES FOR CARRYING OUT THE INVENTION

Referring first to FIG. 1, a flotation aid 10 of the invention comprises an elongate length of closed cell foam material 12 which is in the shape of an elongate rectangular cylinder when untwisted. Typically, in cross-section, the foam measures from 40 mm×40 mm to 90 mm×90 mm in uniform cross-section, and has a length varying from 700 mm to 1500 mm or more, depending on the size of the person it is designed to fit. More particularly, for infants from between 0 and 2 years of age, the length of foam has a rectangular cross-sectional dimension measuring 40 mm×55 mm and a length of approximately 850 mm. The average cross-sectional area:length ratio is typically from 2.0 to 4. 3, and is preferably around 2.6. For children from 2 to 9 years, the length of foam typically has a square cross-sectional dimension of 65 mm×50 mm and a length of 1050 mm. In this case, the average cross-sectional area:length ratio is typically from 2.0 to 5.3, and is preferably around 3.0. For children of 10 years and above and adults. the length of foam has a roughly square cross-sectional dimension of 70 mm×70 mm and an overall length of 1300 mm to 1400 mm. The average cross-sectional area:length ratio is typically from 1.8 to 5.8, and is preferably around 3.5.

The length of the strip must be such that it does not project significantly below the waist of the user. The cross-sectional area needs to be sufficient to ensure that the volume of the strip provides sufficient buoyancy, and that there is sufficient support around the head and neck of the user without being bulky to the extent that it interferes unduly with arm and body movements associated with watersports activities, such as paddling and swimming.

The foam may be a polyurethane, polyethylene or PVC-based closed cell foam, and is preferably an Airex S32.50 PVC closed cell foam manufactured by Alusuisse Airex AG in Switzerland, having a density of 50 $kgm^{-1}$ and a buoyancy of $8800Nm^{-3}$. The resultant buoyancy of the 0–2 year version is just over 15N, and that of the 2–9 year version is just over 30N so as to conform with compulsory South African flotation aid specification VC 8032. The adult version has a buoyancy of around 52N so as to conform in addition with EN 393, the European Union buoyancy aid specification. In the particular embodiment, the length of foam 12 is coated with a skin 14, which is made from a plastics or rubber compound such as PVC, polyurethane or polyethylene which has, after treatment with appropriate solvents, been sprayed on or dipped and allowed to dry to form an integral skin Alternatively, the skin 14 may be formed from a woven material, such as a knitted nylon or Lycra®.

A waist strap 16 extends through elongate die cut slot-like apertures 18 and formed towards the free ends of the length of foam. The apertures 18 and 20 are reinforced by means of plastics or rubber grommets 22 which prevent the strap 16 from chafing against the foam edges and widening the apertures 18 and 20 unduly. An upper chest strap 24 extends through an upper set of apertures 26 and 28 which are similarly provided with reinforcing grommets 22. Both the upper chest strap 24 and the lower waist strap 16 are formed from lengths of webbing, and terminate in an adjustable buckle arrangement comprising a three-pronged insert 30 arranged to locate within a complemental socket formation 32 in a snap fit.

The flexible length of foam 12 is bent into an inverted U-configuration, having a pair of arm portions 12A and 12B joined by a bight portion 34 which is twisted anti-clockwise relative to the arms by around 90° so as to define head and neck surfaces 34A and 34B against which the neck and head of a wearer can be rested, as is shown in figure 2A. It can clearly be seen in FIGS. 2 and 2A how the flotation aid is fitted comfortably and securely to a swimmer or paddler, with the twisted bight portion 34 locating snugly against the head and neck 37 of the swimmer. The straps are buckled at the rear and are tensioned so as to secure the flotation aid in position. An elasticated strip 38 may be sewn between the free ends of the arm portions 12A and 12B of the flotation aid so as to pull the free ends of the arms together. In order to provide additional neck and head support, an insert 40 may be glued on top of the head surface 34A, the insert having a triangular profile so as to ensure that the head remains in an upright position. This embodiment finds particular application in the case of smaller children, paraplegics and the like who have weak or poorly controlled neck muscles. Inward twisting of the aim portions is facilitated by the fact that the apertures 18, 20, 26 and 28 are pulled by the straps into a position where each set of apertures are aligned and parallel to the body of the user.

In FIGS. 1, 2A and 2B, a further modification of the flotation aid is illustrated. This modification is typically applied to the smallest model of the flotation aid having the dimensions described above and used for infants of up to two years. In order to prevent the bight portion 34 from slipping over the neck of the infant, a retaining strap 42 is stitched at 44 so as to form an anchoring loop 46 around the centre of the bight portion. The strap 42 is arranged to be looped beneath and back over an intermediate loop 47 extending from the back of the chest strap 24, after which it is secured in position by means of patches of Velcro® 50, thereby constituting a simple harness. The strap 42 also serves to pull back the bight portion 34 so as not to force the neck of the infant too far forward.

Referring now to FIGS. 3A to 3D, various steps are shown in the manufacture of a flotation aid of the invention. Elongate square cylindrical strips 52 are cut from a prismatic moulded block 54 of Airex S 32.50 PVC closed cell foam using a non-serrated band saw, with the parallel equi-spaced rectilinear cuts 56 made in the prismatic block resulting in the square cylindrical strips 52. After the individual strips have been cut from the block 54, two pairs of rectangular strap-receiving slits or apertures 58 are die cut towards opposite ends of the strip 52. Reinforcing PVC grommets or rings 60 are then glued around the slits 58 using a suitable adhesive or solvent such as cyclohexanone. After a number of strips 52 have been prepared in this manner, they are threaded via the apertures 58 onto four flat bars 62 which are removably clamped to a rectangular frame 64 forming part of a spraying rack 66. The rectangular frame 64 is mounted pivotably on a pair of support legs 68 which allows the frame 64 to be freely rotated for exposure of opposite faces of the foam strips 52.

In FIG. 4, a top plan view of the foam block 54 is shown in which adjacent cuts 56A and 56B are non-parallel, alternate cuts 56A are parallel and alternate cuts 56B are parallel. For clarity of illustration, the slant of the alternate cuts 56B has been exaggerated. Normally the slant angle would be half a degree or less, with the result that the increase in cross-sectional area of the strip over its entire length of approximately 1.4 m is approximately 0.01 m. As a result, the thicker arm portion is slightly more buoyant than the thinner arm portion, which creates an unstable turning moment to flip the wearer onto his or her back in the event of the wearer adopting a face-downwards position in the water. In an alternative version of the invention, the buoyancy of one arm may be increased relative to the other by making it slightly longer.

A spray-coating solution is then mixed. In a typical batch, 16 kg of PVC chips are mixed with 201 of cyclohexanone, a solvent which dissolves PVC. The solution is then further diluted using 151 of methylethylketone and 151 of methylisobutylketone, after which 0.31 of appropriate pigment such as a neon green pigment manufactured by Custom Colours (Pty) Ltd of 195 Koomhof Road, Meadowdale, Gauteng, South Africa, is added. The resultant solution 70 is then sprayed onto the strips 52 via a suitable spray gun 72 and is allowed to dry for approximately 4 hours. The frame 64 can be rotated to any desired position to access the various surfaces of the strips for spraying purposes.

The individual strips 52 are then removed from the bars 62 and, as is clear from FIG. 3D, upper and lower webbing straps 24A and 16A are then threaded through the strap-receiving apertures 58 after the strip 52 has been bent into an inverted U so as to define arm portions 52A and a bight portion 52B. Snap-fit buckle arrangements including insert and socket portions 30A and 32A are then fitted to the free ends of the straps 24A and 16A. In order to fit the flotation aid, the buckles are disengaged and the bight portion 52B is then passed over the neck of the user, with the webbing straps 24A and 16A passing around the back of the user and the arm portions 52A extending over the torso of the user. In order to tighten the flotation aid, the free ends 74 of the straps are gripped and pulled away from one another, with the result that the arm portions 52A are pulled towards one another, with the buckles resting on the operatively outermost surface 76 of the strip.

It can be seen both from FIG. 5 and from FIG. 6 how the head and neck of the user rests against this outermost surface 76 of the bight portion which is flexed back relative to the relaxed position of the strip illustrated in FIG. 3D and in broken outline at 78 in FIG. 6. The resilience of the foam strip results in a restoring force in the direction of arrow 80 towards the relaxed position 78, which serves to increase the support of the head and neck of the user when in the 45° floating position illustrated in FIG. 6.

A major advantage of the flotation aid of the invention is that it is relatively cheap and simple to manufacture, the elongate strips merely being cut from a block of foam, with minimal offcut-related wastage. A pre-cut U-shaped version would result in significant offcut-related wastage, and the provision of dedicated moulds would add significantly to the costs of production. As it is formed from a closed cell foam material, the flotation aid does not suffer the disadvantages of inflatable flotation aids. In addition, the particular configuration of the flotation aid allows it to provide the requisite flotation support As the centre of buoyancy of the flotation aid is located at or above both the centres of buoyancy and gravity of the person which it supports, it allows for a stable floating position with the head uppermost, and with minimal chance of the wearer toppling or falling into a face-forward position.

Another important advantage of the flotation aid of the invention is that it can easily be adjusted to the size of the user by moving the arms towards or away from one another. In particular, the flexibility of the strip allows the bight portion to fit snugly around the neck and head of the particular wearer, providing the requisite support cradle. The buoyancy distribution of the flotation aid is such that the centre of buoyancy is concentrated towards the head and neck, thereby ensuring a stable and safe substantially upright floating position in which the face of the wearer is above the water level.

This floating position is vital in situations where the wearer is concussed or unconscious. The additional head and neck support provided by the flotation aid is also of particular importance when the flotation aid is worn both by infants and disabled persons.

I claim:

1. A flotation aid comprising an elongate substantially straight flexible strip of a closed cell foam material bent into a U-configuration so as to define a pair of spaced apart arm portions extending from a bight portion, and securing means connected to the arm portions, whereby the bight portion is arranged to rest behind the neck of a user and the arm portions are arranged to extend downwardly over the shoulders and chest of the user, the securing means being arranged to extend around the torso of the user for holding the arm portions in position against the chest of the user, and comprising at least one adjustable securing strap which is slidably connected to each of the arm portions such that the spacing between the arm portions can be adjusted for allowing the bight portion to be fitted snugly around the neck of the user.

2. A flotation aid according to claim 1 in which a strap-receiving aperture is formed through each arm portion for receiving the securing strap in a sliding fit.

3. A flotation aid according to claim 2 in which each of the arm portions is formed with at least a pair of strap-receiving apertures extending therethrough for slidably receiving an upper chest strap and a lower waist strap.

4. A flotation aid according to claim 3 in which includes a retaining strap anchored at a fixed end to the bight portion and including fastening means at a free end of the strap for fastening it detachably to an intermediate rear portion of the chest strap.

5. A flotation aid according to claim 1 in which the strip of foam material is provided with a covering in the form of a conformal spray-coated skin.

6. A flotation aid according to claim 3 in which each aperture is provided with at least one reinforcing grommet.

7. A flotation aid according to claim 1 in which the strip of foam material has a substantially constant cross-sectional area along its length, and has a cross-sectional area to a length ratio from about 1.8 to 5.8, preferably from 2.0 to 5.3, and more preferably from 2.6 to 3.5.

8. A flotation aid according to claim 1 in which the elongate strip of foam material is rectangular in cross-section, and has a gradually increasing cross sectional area along its length.

9. A method of manufacturing a flotation aid comprising the steps of:

a) providing a plurality of substantially straight flexible elongate strips formed from closed cell foam material;

b) bending each strip into a U-configuration so as to define a pair of arm portions extending from a bight portion; and c) slidably anchoring an adjustable securing strap to each of the arm portions, whereby the bight portion is arranged to rest behind the neck of a user and the arm portions are arranged to extend downwardly over the shoulders and chest of the user, with the adjustable securing strap being arranged to extend around the torso of the user for holding the arm portions in position against the chest of the user, the spacing between the arm portions being adjustable for allowing the bight portion to be fitted snugly around the neck of the user.

10. A method of manufacturing a flotation aid according to claim 9 which includes the steps of forming at least two strap-receiving apertures in each strip, and slidably anchoring the securing strap by passing it through the apertures.

11. A method of manufacturing a flotation aid according to claim 9 which includes the step of applying a covering to each strip prior to bending each strip into a U-configuration.

12. A method according to claim 10 which includes the step of applying at least one reinforcing grommet around at least one opening of each strap-receiving aperture.

13. A method of manufacturing a flotation aid according to claim 11 in which the covering step includes the step of spraying a coating on each strip, the coating comprising a solution which conforms with the foam material so as to form an integral skin therewith.

14. A method according to claim 12 which includes the step of applying reinforcing grommets around both openings of each strap-receiving aperture prior to spraying a coating on each strip, the coating comprising a solution which conforms with the foam material so as to form an integral skin therewith, whereby the skin assists in holding the grommets in position.

15. A method according to claim 13 in which the spray coating step includes the initial step of threading the strips via their apertures onto bars forming part of a spraying rack.

16. A method according to claim 9 which includes the initial step of cutting the plurality of substantially straight elongate strips from a block of foam material, the block of foam being prismatic in form, by making rectilinear cuts in the foam with adjacent cuts being non-parallel and alternate cuts being parallel so as to define trapezoidal strips of foam having a gradually increasing area along their length.

* * * * *

UNITED STATES PATENT AND TRADEMARK OFFICE
CERTIFICATE OF CORRECTION

PATENT NO : 5,928,046

DATED : July 27, 1999

INVENTOR(S) : Jeanette Sheelagh Constan-Tatos

It is certified that error appears in the above-identified patent and that said Letters Patent is hereby corrected as shown below:

In column 2, line 28, please insert a period after "aperture".

In column 3, line 32, please change "50 $kgm^{-1}$" to --50 $kgm^{-3}$--.

In column 3, line 44, please insert a period after "skin" and before "Alternatively".

In column 3, line 48, please insert the number --20-- after "18 and".

In column 4, line 13, please change "aim" to --arm--.

In column 5, line 4, please change "Koomhof" to --Koornhof--.

In column 5, line 46, please insert a period after "support".

Signed and Sealed this

Twenty-ninth Day of February, 2000

*Attest:*

*Attesting Officer*

Q. TODD DICKINSON

*Commissioner of Patents and Trademarks*